US005168209A

United States Patent [19]

Thiel, V

[11] Patent Number: 5,168,209

[45] Date of Patent: Dec. 1, 1992

[54] AC STABILIZATION USING A LOW FREQUENCY ZERO CREATED BY A SMALL INTERNAL CAPACITOR, SUCH AS IN A LOW DROP-OUT VOLTAGE REGULATOR

[75] Inventor: Frank L. Thiel, V, Sachse, Tex.

[73] Assignee: Texas Instruments Incorporated, Dallas, Tex.

[21] Appl. No.: 715,180

[22] Filed: Jun. 14, 1991

[51] Int. Cl.[5] ..... G05F 3/30

[52] U.S. Cl. ..... 323/313; 323/314; 323/315; 323/907; 307/491; 307/591

[58] Field of Search ..... 323/313, 314, 315, 907; 307/491, 591

[56] References Cited

U.S. PATENT DOCUMENTS

| | | | |
|---|---|---|---|
| 4,500,831 | 2/1985 | Akram | 323/315 |
| 4,908,566 | 3/1990 | Tesch | 323/280 |
| 5,023,567 | 6/1991 | O'Shaughnessy et al. | 330/253 |
| 5,029,295 | 7/1991 | Bennett et al. | 323/313 |

*Primary Examiner*—Emanuel T. Voeltz
*Attorney, Agent, or Firm*—B. Peter Barndt; Robby T. Holland; Rene Grossman

[57] ABSTRACT

AC stabilization and temperature compensation improves phase margin and permits high temperature (significantly above 125° C.) operation for an exemplary low drop-out voltage regulator with a PNP output transistor. The low drop-out voltage regulator (FIG. 1) includes a PNP output transistor ($Q_{OUT}$) together with a voltage reference circuit (12), a gain circuit (14), and a current limit circuit (16). To provide AC stabilization, a small internal capacitor ($C_{INT}$) of about 10 pF is coupled between the input of the gain circuit and the base of the output PNP, using Miller multiplication to substantially increase the effective capacitance of the stabilization capacitor, and introducing a zero into the gain-phase plot for the voltage regulator, substantially cancelling the pole, with a concomitant increase in phase margin. To provide temperature compensation, a dual-collector temperature compensation PNP ($Q_{TC}$) is configured as a current mirror current source that, at high temperatures with collector currents less than uncompensated or resistively compensated junction leakage currents, the temperature compensation PNP provides the required negative base drive to supply sufficient hole current into the base of the output PNP to offset junction leakage.

13 Claims, 2 Drawing Sheets

5V REGULATOR STABILITY WITHOUT $C_{INT}$

5V REGULATOR STABILITY WITH $C_{INT}$

AC STABILIZATION USING A LOW FREQUENCY ZERO CREATED BY A SMALL INTERNAL CAPACITOR, SUCH AS IN A LOW DROP-OUT VOLTAGE REGULATOR

TECHNICAL FIELD OF THE INVENTION

The invention relates generally to integrated circuits, and more particularly relates to providing AC stabilization using a low frequency pole created by a small internal capacitor. In even greater particularity, an improved low drop-out voltage regulator (with PNP output) uses the AC stabilization technique, along with (a) temperature compensation for the PNP output transistor to permit operation significantly above 125° C., and (b) a bandgap interface for a bandgap voltage reference that prevents saturation and reduces early voltage mismatch.

BACKGROUND OF THE INVENTION

Low drop-out (LDO) voltage regulators are used for applications in which the difference between supply voltage and regulated voltage (drop-out) is relatively low—0.5 volts and less. Automotive electronics is a common application for such voltage regulators.

The specific problem to which the invention has applicability is the design of a LDO voltage regulator with (a) enhanced frequency stability (minimum AC ripple on the output), (b) the ability to operate at relatively high temperatures (around 175° C.), and (c) protection from saturation and/or early-voltage mismatch errors associated with the use of bandgap voltage reference circuits.

LDO voltage regulators commonly use relatively large PNP transistors in the output stage because of the need to supply output current even under low drop-out conditions (i.e., conditions where the headroom required for an NPN output stage could not be provided). A disadvantage is that lateral PNP transistors used in typical N-epitaxial processes are characterized by relatively low transition frequencies compared to NPN transistors (which is why non-LDO voltage regulators typically use NPN transistors in the output stage). As a result, the phase margin for the voltage regulator is relatively small, introducing stability problems that can cause AC ripple on the output, or even operational instability.

Temperature stability is another problem for low drop-out voltage regulators operating with a wide range of output PNP collector current. As temperature rises significantly above about 125° C., junction leakages cause the internal reference to drift upward such that, under conditions of low output collector current, the base of the transistor must be supplied with hole current to maintain regulation.

The common use of semiconductor bandgap voltage reference circuits to provide a voltage reference creates additional problems in designing an appropriate interface to the gain circuitry over a wide range of operating conditions. A typical approach is a single-sided interface. Due to early-voltage effects, the currents in the two legs of the reference circuit are susceptible to mismatch errors. Also, during start-up or an externally-forced deregulation, the transistors in one leg of the reference circuit can be forced into saturation, thereby preventing normal voltage reference operation.

Accordingly, a need exists for an LDO voltage regulator design that provides AC stabilization to minimize AC ripple on the output, temperature compensation to allow operation significantly above 125° C., and for those voltage regulators using a bandgap voltage reference, a bandgap interface that reduces early voltage mismatch errors and prevents saturation.

SUMMARY OF THE INVENTION

The invention provides AC stabilization for a linear closed loop circuit by introducing a low frequency pole created by a small internal capacitor. In an exemplary application, the AC stabilization technique is used in a low drop-out voltage regulator (PNP output)—the voltage regulator also incorporates (a) temperature compensation for the PNP output transistor to permit operation significantly above 125° C., and (b) a bandgap interface for a bandgap voltage reference to prevent saturation and reduce early voltage mismatch.

In one aspect of the invention, for a linear closed loop circuit that has a low frequency pole in its gain-phase plot, AC stabilization is obtained by including a stabilization capacitor coupled between a node with relatively low impedance and a node with relatively high impedance, which are approximately 180 degrees out of phase. Miller multiplication increases the effective capacitance of the stabilization capacitor to create a low frequency zero that substantially cancels the low frequency pole, thereby increasing the phase margin.

In a second aspect of the invention, for a circuit with a PNP transistor that operates with collector currents that at high temperatures can be below uncompensated or resistively compensated junction leakage currents, temperature compensation is obtained by including a temperature compensation current source that can provide the required negative base drive (hole current into the base) to the PNP that cannot be provided by the normal PNP control circuit. At relatively low operating temperatures, the control circuit pulls current both from the base of the PNP and from the temperature compensation current source. At relatively high operating temperatures and collector currents below uncompensated or resistively compensated junction leakage currents, the temperature compensation current source provides the required negative base drive.

In a third aspect of the invention, for a circuit with a bandgap voltage reference circuit, a bandgap interface is coupled between two nodes on respective legs of the bandgap reference circuit. The bandgap interface causes the two legs of the bandgap reference circuit to be in a common-mode condition to significantly reduce the occurrence of saturation and early-voltage mismatch.

In an exemplary embodiment, each of these aspects of the invention is incorporated into a low drop-out voltage regulator to provide AC stabilization, temperature compensation for the PNP output transistor, and a bandgap interface that prevents saturation and early voltage mismatch.

A relatively small (about 10 pF) stabilization capacitor is coupled between a relatively high impedance node at the output of the voltage reference circuit and a relatively low impedance node at the output PNP, which nodes are 180 degrees out of phase. Miller multiplication increases the effective capacitance of the small stabilization capacitor to create a low frequency zero that substantially cancels the low frequency pole in the gain phase plot which is created by the output PNP, thereby increasing the phase margin.

A temperature compensation dual-collector PNP is configured as a current mirror with one collector and the base coupled to a current source and the other collector (a current-mirror collector) coupled to the base of the output PNP. At relatively low operating temperatures (below about 125° C.), the voltage regulator's gain circuit pulls current both from the base of the output PNP and from the current-mirror collector of the temperature compensation PNP. At relatively high operating temperatures (significantly above 125° C.) and output PNP collector currents below the uncompensated or resistively compensated junction leakage current, the temperature compensation PNP is able to provide negative base drive to the output PNP.

A bandgap interface comprises a differential amplifier with two transistors respectively coupled to nodes on respective legs of the bandgap reference circuit, causing a common-mode condition. One of the two interface transistors also provides the first gain stage for the voltage regulator.

The technical advantages of the invention include the following. AC stabilization achieved by introducing a low frequency zero to offset a low frequency pole improves phase margin and reduces associated AC ripple. The low frequency pole can be provided by a relatively small internal capacitor, the effective capacitance of which is increased using Miller multiplication. Temperature compensation for PNP transistors is accomplished using a current source to provide negative base drive for the temperature-compensated PNP under high temperature conditions (significantly above 125° C.) and collector currents below junction leakage currents. In one exemplary application, an improved low drop-out voltage regulator is achieved by incorporating both AC stabilization and temperature compensation, as well as a bandgap interface that prevents saturation and early-voltage mismatch errors.

BRIEF DESCRIPTION OF THE DRAWINGS

For a more complete understanding of the invention, and for further features and advantages, reference is now made to the following Detailed Description of an exemplary embodiment of the invention, taken in conjunction with the accompanying Drawings, in which.

DETAILED DESCRIPTION OF THE INVENTION

The Detailed Description of an exemplary embodiment of the low drop-out voltage regulator is organized as follows:

1. Low Drop-Out Voltage Regulator
1.1. Reference/Gain Stages
1.2. AC Stabilization
1.3. Temperature Compensation
1.4. Supporting Circuitry
2. Conclusion The exemplary embodiment is a low drop-out voltage regulator that incorporates both AC stabilization and temperature compensation, and includes the bandgap interface. However, each of these aspects of the invention has general applicability: AC stabilization has general applicability for linear closed loop systems with low frequency poles, temperature compensation has general applicability to PNP transistors for which operation with collector currents that at high temperatures can be below uncompensated or resistively compensation junction leakage currents, and the bandgap interface has general applicability to bandgap reference circuits.

1. Low Drop-Out Voltage Regulator. The low drop-out voltage regulator provides a source of regulated voltage where the difference between the supply voltage, such as a battery, and the regulated voltage may be 0.5 volts or less. The LDO voltage regulator is designed to be included in a integrated circuit product, such as an automotive microcontroller, where ability of the voltage regulator to provide a highly stable output with minimum AC ripple, and to operate at temperatures in the range of 175° C., provides a number of advantages for the overall design of the integrated circuit.

Figure 1:
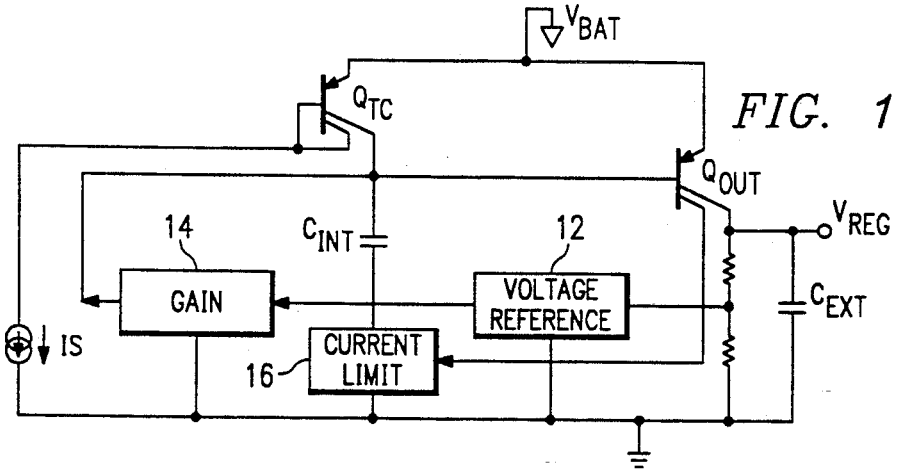
FIG. 1 is a functional illustration of the exemplary low drop-out voltage regulator with AC stabilization and temperature compensation.

FIG. 1 is a functional illustration of the LDO voltage regulator that is coupled to source of supply voltage $V_{BAT}$ and provides a regulated output voltage $V_{REG}$. The basic voltage regulator comprises a PNP output transistor $Q_{OUT}$ together with a voltage reference circuit 12, a gain circuit 14, and a current limit circuit 16.

This basic LDO voltage regulator is susceptible to instability problems that can be manifested as significant AC ripple on the output, or even operational instability. This susceptibility is caused by a low frequency pole in the gain phase plot for the regulator, resulting in a relatively low phase margin (which might be less than 10 degrees). See, Section 1.2 and FIG. *3a*.

To provide AC stabilization of the output VREG, the exemplary LDO voltage regulator incorporates a small internal capacitor $C_{INT}$(about 10 pF), coupled between the input of the gain circuit 14 and the base of the output PNP $Q_{OUT}$. The input of the gain circuit constitutes a relatively high impedance node, while the base of the output PNP constitutes a relatively low impedance node.

In this configuration, Miller multiplication can be used to substantially increase the effective capacitance of $C_{INT}$, using the gain of the voltage regulator to provide the increase in effective capacitance. By the appropriated selection of the value of $C_{INT}$, a zero can be introduced into the gain-phase plot for the voltage regulator, substantially cancelling the pole, with a concomitant increase in phase margin. See, Section 1.2 and FIG. *3b*.

The basic LDO voltage regulator is not able to operate at temperatures significantly above 125° C. At high temperatures, the leakage across the base-collector junction of the output PNP $Q_{OUT}$ are such that the internal reference rises due to the fact that, at low output collector currents, the base is no longer outputting current, but rather, must draw current to continue operation. That is, the output PNP requires negative base drive (hole current into the base).

To permit operation substantially above 125° C., the exemplary LDO voltage regulator incorporates a dual-collector temperature compensation PNP transistor $Q_{TC}$ configured as a current mirror current source. At high temperatures and collector currents less than uncompensated or resistively compensated junction leakage currents, the temperature compensation PNP provides the required negative base drive to supply sufficient hole current into the base of the output PNP $Q_{OUT}$ to offset junction leakage.

Figure 2:
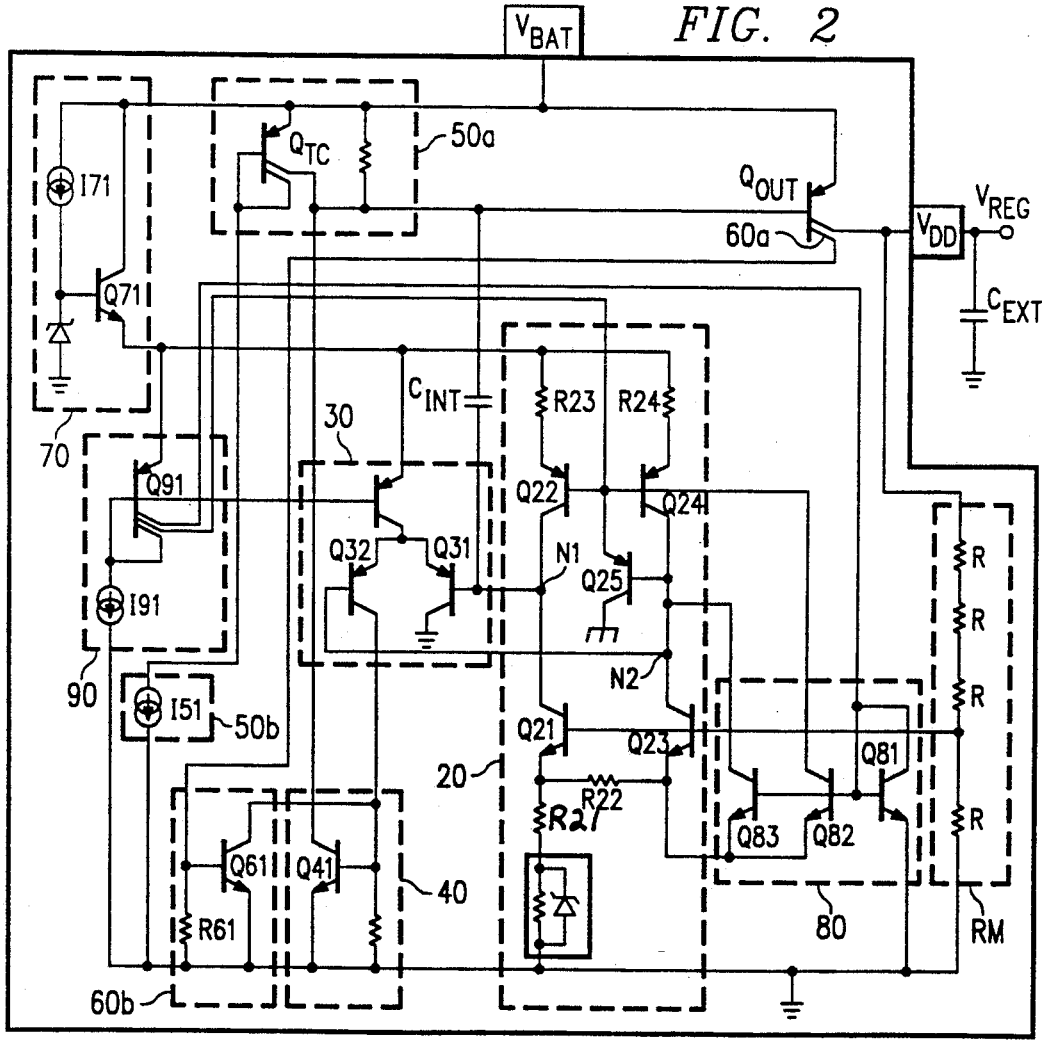
FIG. 2 is a schematic illustration of the low drop-out voltage regulator; and FIGS. *3a–3b* are phase-gain plots for the low drop-out voltage regulator respectively without and with AC stabilization.

FIG. 2 is a schematic illustration of the exemplary LDO voltage regulator. The reference/gain stages comprise a bandgap voltage reference circuit 20, a bandgap interface 30, and a gain circuit 40, and a resistor multiplier RM. The AC stabilization/temperature compensation stages comprise the internal stabilization capacitor $C_{INT}$ and the temperature compensation current source 50*a*/50*b*. Supporting circuitry comprises a current limiter 60*a*/60*b*, a start-up circuit 80, a pre-regulator 70, and a current source/temperature compensation circuit 90.

1.1. Reference/Gain Stages. A standard silicon bandgap voltage reference 20 is formed by Q21/Q22, Q23/Q24, Q25, and R21–R24. Q21 and Q22 form one leg of the bandgap reference and are separated by a node N1, while Q23 and Q24 form the second leg of the bandgap reference and are separated by a node N2.

The bandgap reference 20 generates a first-order temperature independent 1.25 V on the bases of Q21 and Q23. An exemplary relative emitter area of these transistors would be about 1:8. This voltage is multiplied to 5.0 V by the resistor multiplier RM formed by four resistors R, each with the same value.

The bandgap interface 30 to the bandgap reference 20 is a differential amplifier formed by Q31/Q32, with the base of Q31 being coupled to the node N1 on the first leg of the bandgap reference and the base of Q32 being coupled to the node N2 on the second leg. The bandgap interface accomplishes two functions: (a) it common-modes the two legs of the bandgap reference to approximately the same voltage, preventing Q21 and Q22 from saturating and reducing early-voltage mismatch error, and (b) it forms an input to the gain stage 40, providing some initial loop gain.

The gain stage 40 is formed by Q41, which drives the output device $Q_{OUT}$. In addition to loop gain, the gain stage provides a required phase inversion.

Figure 3A:
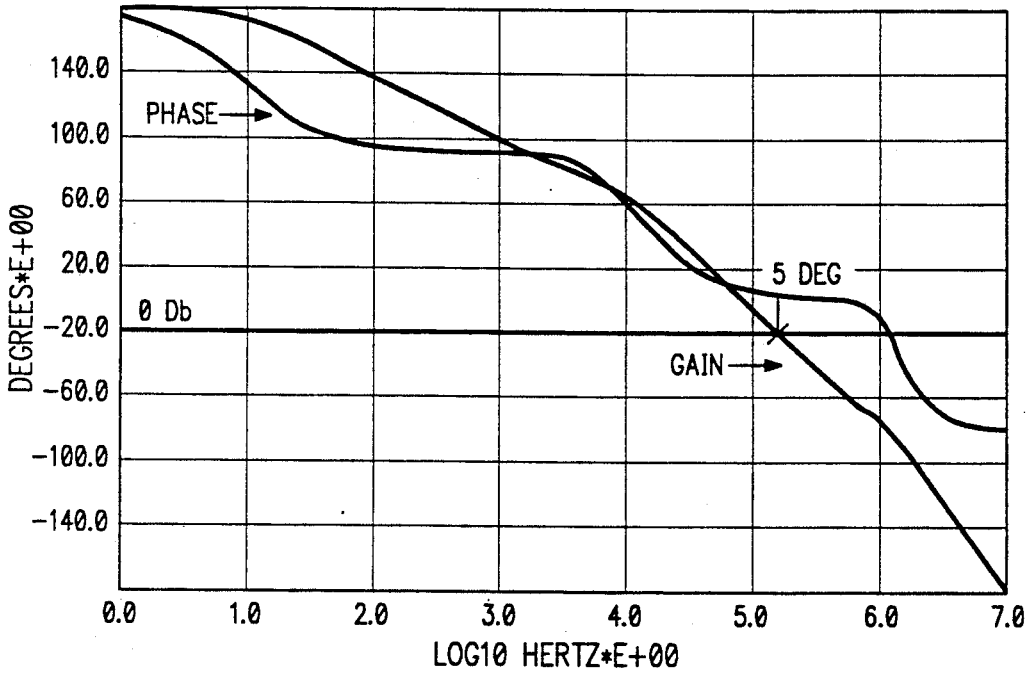
Figure 3B:
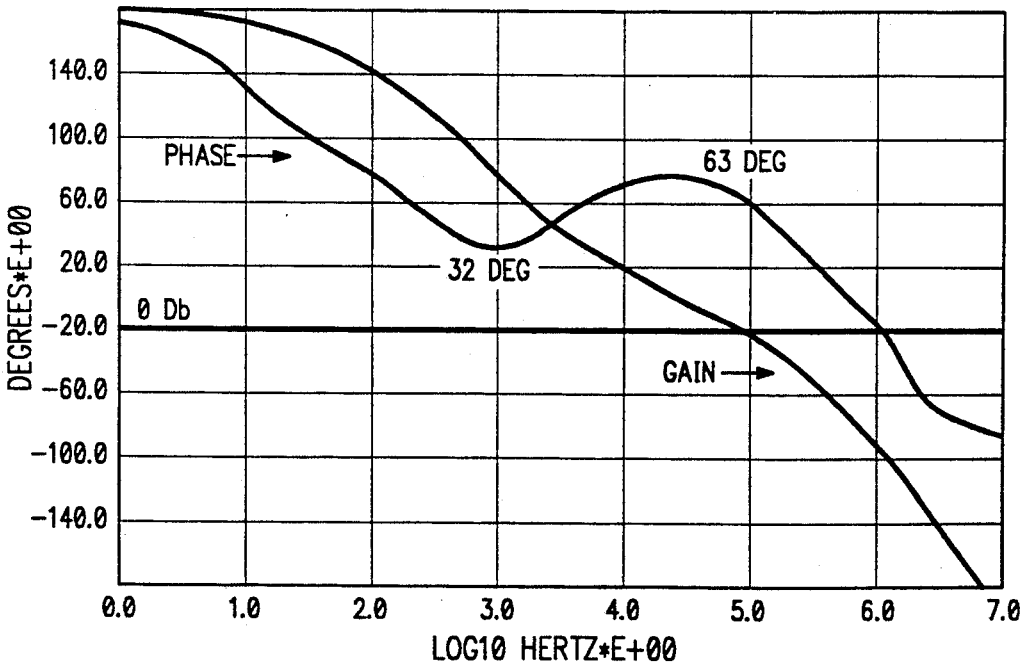

1.2. AC Stabilization. FIGS. 3*a* and 3*b* provide gain-phase plots that illustrate the use of the internal stabilization capacitor $C_{INT}$ to achieve AC stabilization.

Referring to FIG. 3*a*, adding an external capacitor $C_{EXT}$ provides a low frequency pole which gives a gradual roll-off in the voltage gain of about 20 dB/decade. However, this alone results in only about a nominal 5 degrees phase margin, which is insufficient to guarantee stability.

Referring to FIG. 3*b*, the internal stabilization capacitor $C_{INT}$ creates a zero in the voltage transfer function of the LDO voltage regulator. Adding this zero holds the phase of the regulator up while the voltage gain drops, improving the overall phase margin to about 63 degrees (at the lowest point on the phase curve, the phase difference is still 32 degrees).

The internal stabilization capacitor $C_{INT}$ is coupled between the input to the gain stage, i.e., the base of Q31 in the bandgap interface 30, and the base of the output PNP $Q_{OUT}$. That is, it is located between respective low impedance and high impedance nodes that are 180 degrees out of phase, and that have a substantial voltage gain difference. This configuration takes advantage of Miller multiplication to substantially increase the effective capacitance provided by $C_{INT}$, lowering the frequency at which the zero enters the equation to a useable value. A conventional technique would have been to introduce another pole somewhere to try and lower the gain while maintaining the phase, but this requires a very large internal capacitor.

1.3. Temperature Compensation. Referring to FIG. 2, the temperature compensation current source 50*a*/50*b* includes the temperature compensation dual-collector PNP $Q_{TC}$ configured as a current mirror, and a current source I51. The temperature compensation current source may use any p-type device.

$Q_{TC}$ is configured with its base and one collector coupled to the current source I51, and the other collector, the current-mirror collector, coupled to the base of the output PNP $Q_{OUT}$. It has a relatively low constant current output, but is operating at a higher current density than $Q_{OUT}$.

$Q_{TC}$ provides a fixed-ratio current pull-up to the base of the output PNP, offsetting the high temperature leakage across the base-collector junction. Under low temperature conditions, Q41 in gain circuit 40 pulls current both from the base of the output PNP $Q_{OUT}$ and from the temperature compensation PNP $Q_{TC}$. Under high temperature conditions, current through Q41 is reduced, and QTC now provides negative base drive to supply hole current into the base of the output PNP.

With the temperature compensation current source 50*a*/50*b*, the operational range of the LDO voltage regulator can be extended up to about 175° C.

1.4. Supporting Circuitry. Referring to FIG. 2, the LDO voltage regulator includes supporting circuitry comprising current limiter 60*a*/60*b*, pre-regulator 70, startup circuit 80, and current source 90.

The current limiter 60*a*/60*b* includes a ratioed collector 60*a* from the dual-collector output PNP QOUT, and the combination 60*b* of Q61 and resistor R61. Current limiting is accomplished by using the ratioed QOUT collector voltage to mirror a fraction of the output collector current to the Q61/R61, thereby reducing drive to the output should the fixed-ratio current exceed the VBE voltage of Q61 divided by the R61 resistance.

Pre-regulator 70 includes Q71 and current source I71. It provides a voltage rail for the bandgap reference 20. While the voltage supply line $V_{BAT}$ could have been used, providing the pre-regulator increases stability and accuracy.

Startup Circuit 80 includes Q81, Q82, and Q83. It both forces the bandgap voltage up, and sends some current around the loop by giving base drive to the transistor Q32 in the bandgap interface 30, and thence to the gain stage 40, when power is first applied to $V_{BAT}$.

Current source/temperature compensation circuit 90 includes a bandgap temperature compensation current source formed by PNP Q91 and a current source 91. It provides a current source for the bandgap reference circuit 20 and the startup circuit 80. In addition, it performs the same temperature compensation function for the bandgap reference circuit 20 as performed by the temperature compensation circuit 50*a*/50*b*. Again, any p-type device could be used for Q91.

2. Conclusion. Although the Detailed Description of the invention has been directed to certain exemplary embodiments, various modifications of these exemplary embodiments, as well as alternative embodiments, will be suggested to those skilled in the art. For example, other circuits for which the AC stabilization scheme could be used include operational amplifiers, while other circuits for which the temperature compensation scheme could be used include a high-side drive circuit for which operation at high temperature would be desirable.

It is to be understood that the invention encompass any modifications or alternative embodiments that fall within the scope of the appended Claims.

What is claimed is:

1. An AC stabilization circuit for frequency stabilization in a voltage regulator having a low frequency pole in its gain-phase plot, comprising:

a PNP transistor controlled by a gain circuit that receives a reference voltage from a voltage reference circuit;

a stabilization capacitor coupled between the input to the gain circuit and the PNP transistor base, said input to the gain circuit and the PNP transistor base being 180 degrees out of phase such that Miller multiplication increases the effective capacitance of said stabilization capacitor to create a low frequency zero that substantially offsets the low frequency pole, thereby increasing the phase margin; and a temperature compensation current source for providing a fixed current output coupled to the base of the output PNP transistor;

such that said temperature compensation current source provides negative base drive to the output PNP transistor under high temperature conditions in which the PNP transistor output collector currents are below uncompensated or resistively compensated junction leakage currents.

2. An AC stabilizer circuit of claim 1, wherein the temperature compensation current source comprises:

a temperature compensation dual-collector PNP transistor configured as a current mirror with the base and one collector being coupled to a current source, and a current-mirror collector being coupled tot he base of the output PNP transistor;

such that, at relatively low operating temperatures, the gain circuit pulls current both from the base of the output PNP transistor and from the current-mirror collector of the temperature compensation PNP transistor, while at relatively high operating temperatures and output PNP transistor collector currents below uncompensated or resistively compensated junction leakage currents, the current-mirror collector of the temperature compensation PNP transistor provides hole current to the output PNP transistor.

3. A low drop-out voltage regulator with a low frequency pole in its gain-phase plot, comprising:

an output PNP transistor controlled by a gain circuit that receives a reference voltage from a voltage reference circuit;

a stabilization capacitor coupled between a relatively high impedance node at the input of the gain circuit and a relatively low impedance node at the output PNP transistor;

said low impedance and high impedance nodes being approximately 180 degrees out of phase such that Miller multiplication increases the effective capacitance of said stabilization capacitor to create a low frequency zero that substantially cancels the low frequency pole, thereby increasing the phase margin; and a temperature compensation current source for providing a fixed current output coupled to the base of the output PNP transistor;

such that said temperature compensation current source provides negative base drive to the output PNP transistor under high temperature conditions in which the PNP transistor output collector currents are below uncompensated or resistively compensated junction leakage currents.

4. The low drop-out voltage regulator of claim 3, wherein the temperature compensation current source comprises;

a temperature compensation dual-collector PNP transistor configured as a current mirror with the base and one collector being coupled to a current source, and a current-mirror collector being coupled to the base of the output PNP transistor;

such that, at relatively low operating temperatures, the gain circuit pulls current both from the base of the output PNP transistor and from the current-mirror collector of the temperature compensation PNP transistor, while at relatively high operating temperatures and PNP transistor collector currents below uncompensated or resistively compensated junction leakage currents, the current-mirror collector of the temperature compensation PNP transistor provides hole current to the output PNP transistor.

5. The low drop-out voltage regulator of claim 3, wherein the voltage reference circuit of the voltage regulator comprises a bandgap reference circuit with first and second legs, and wherein the low drop-out voltage regulator further comprises:

a bandgap interface coupled between two nodes on respective legs of the bandgap reference circuit;

said bandgap interface causing the two legs of the bandgap reference circuit to be in a common-mode condition;

such that saturation and early-voltage mismatch conditions are prevented.

6. The low drop-out voltage regulator of claim 5, wherein said bandgap interface comprises:

a differential amplifier that includes first and second transistors;

the base of the first transistor being coupled to a first node on the first leg of said bandgap reference circuit, and the base of the second transistor being coupled to a second node on the second leg of said bandgap reference circuit.

7. The low drop-out voltage regulator of claim 5, wherein said stabilization capacitor is in the range of 10 pF.

8. A temperature compensation circuit for PNP transistors operating under high temperature conditions where collector output current can fall below uncompensated or resistively compensated junction leakage currents, comprising:

a temperature-compensated PNP transistor, the base of which is coupled to a control circuit; and a temperature compensation current source coupled to the base of said temperature-compensated PNP transistor under high temperature conditions in which the PNP transistor output collector currents are below junction leakage currents.

9. The temperature compensation circuit of claim 8, wherein said temperature compensation current source comprises a P-type device.

10. The temperature compensation circuit of claim 9, wherein the temperature compensation current source comprises:

a temperature compensation dual-collector PNP transistor configured as a current mirror with the base and on collector being coupled to a current source, and a current-mirror collector being coupled to the base of the output PNP transistor;

such that, at relatively low operating temperatures, the control circuit pulls current both form the base of said temperature-compensated PNP transistor and from the current-mirror collector of the temperature compensation PNP transistor, while at relatively high operating temperatures and collector currents for the temperature-compensated PNP transistor below junction leakage currents, the current-mirror collector of the temperature compensation PNP transistor provides hole current to the temperature-compensated PNP transistor.

11. An improved thermal voltage reference circuit comprising:

a bandgap voltage reference circuit with first and second legs; and a bandgap interface circuit coupled between two nodes on respective legs of the bandgap reference circuit.

12. The thermal voltage reference circuit of claim 11, wherein said bandgap interface circuit comprises:

a differential amplifier that includes first and second transistors;

the base of the first transistor being coupled to a first node on the first leg of said bandgap reference circuit, and the base of the second transistor being coupled to a second node on the second leg of said bandgap reference circuit.

13. A method of preventing saturation and early voltage mismatch conditions in a bandgap voltage reference circuit with first and second legs, comprising:

providing a bandgap voltage reference circuit having two legs with a node on each leg; and coupling a bandgap interface circuit between the nodes on the respective legs of the bandgap voltage reference circuit wherein the bandgap interface circuit causes the two nodes on respective legs of the bandgap voltage reference circuit to be approximately equal in voltage.

* * * * *